US010576706B2

(12) United States Patent
Mahoney, III et al.

(10) Patent No.: US 10,576,706 B2
(45) Date of Patent: Mar. 3, 2020

(54) METHOD AND APPARATUS FOR CONSTRUCTING FOLDED FLATS FOR HOUSING ABSORBENT ARTICLES

(71) Applicant: The Procter & Gamble Company, Cincinnati, OH (US)

(72) Inventors: William Paul Mahoney, III, Liberty Township, OH (US); Paul Allan Wilhelm, Cincinnati, OH (US); James J. Williams, Dallas, PA (US)

(73) Assignee: The Procter & Gamble Company, Cincinnati, OH (US)

( * ) Notice: Subject to any disclaimer, the term of this patent is extended or adjusted under 35 U.S.C. 154(b) by 842 days.

(21) Appl. No.: 15/139,447

(22) Filed: Apr. 27, 2016

(65) Prior Publication Data

US 2016/0339662 A1 Nov. 24, 2016

Related U.S. Application Data

(60) Provisional application No. 62/163,409, filed on May 19, 2015.

(51) Int. Cl.
*B31B 50/52* (2017.01)
*B31B 50/00* (2017.01)
(Continued)

(52) U.S. Cl.
CPC ..... *B31B 50/00* (2017.08); *B31B 50/006* (2017.08); *B31B 50/52* (2017.08); *B31B 50/80* (2017.08);
(Continued)

(58) Field of Classification Search
CPC ..... B31B 50/00; B31B 50/006; B31B 50/52; B31B 50/80; B31B 2120/30; B31B 2100/0022; B31B 2100/00
(Continued)

(56) References Cited

U.S. PATENT DOCUMENTS 3,420,036 A 1/1969 Hutchinson
4,170,929 A 10/1979 McDowell
(Continued)

FOREIGN PATENT DOCUMENTS

CN 201619258 U 10/2009
CN 201688832 U 4/2010
(Continued)

OTHER PUBLICATIONS

PCT/US2016/029650 PCT International Search Report, dated Aug. 10, 2016, 7 pages.

*Primary Examiner* — Chelsea E Stinson
*Assistant Examiner* — Mary C Hibbert-Copeland
(74) *Attorney, Agent, or Firm* — Daniel S. Albrecht

(57) ABSTRACT

A method and apparatus for constructing a folded flat. The flat may include a first surface having a first panel and a second panel. Each of the first panel and the second panel include an inner edge. Further, the first panel may include a first score line that extends in the machine direction and a tab adjacent the first score line. The tab connects the first panel and the second panel. A folding apparatus may engage the first surface of the flat. The folding apparatus may include an engagement member and a fold assist member. The fold assist member may engage the area between the inner edge of the first panel and the inner edge of the second panel. The engaging member and the fold assist member cooperate fold the flat along the score line to form a folded flat.

15 Claims, 11 Drawing Sheets

(51) Int. Cl.

| | |
|---|---|
| *B31B 110/35* | (2017.01) |
| *B31B 50/80* | (2017.01) |
| *B31B 120/30* | (2017.01) |
| *B31B 100/00* | (2017.01) |

(52) U.S. Cl.
CPC ... *B31B 2100/00* (2017.08); *B31B 2100/0022* (2017.08); *B31B 2110/35* (2017.08); *B31B 2120/30* (2017.08)

(58) Field of Classification Search
USPC ..... 493/10, 91, 316, 30, 27, 168, 169
See application file for complete search history.

(56) References Cited

U.S. PATENT DOCUMENTS

| | | | | |
|---|---|---|---|---|
| 4,279,609 | A * | 7/1981 | Von Wichert | B31B 50/00 493/125 |
| 4,285,682 | A | 8/1981 | Moss | |
| 5,212,656 | A * | 5/1993 | Clary | G01B 11/04 702/84 |
| 5,705,020 | A | 1/1998 | Chiari | |
| 6,477,819 | B1 | 11/2002 | Focke et al. | |
| 7,073,444 | B2 | 7/2006 | Alonso et al. | |
| 7,326,168 | B2 | 2/2008 | Kocherga et al. | |
| 2014/0245701 | A1 | 9/2014 | Loevenich | |
| 2014/0245702 | A1 | 9/2014 | Loevenich | |

FOREIGN PATENT DOCUMENTS

| | | | |
|---|---|---|---|
| CN | 201998462 | U | 3/2011 |
| CN | 202358365 | U | 11/2011 |
| CN | 202916862 | U | 9/2012 |
| CN | 203267280 | U | 4/2013 |
| CN | 203580231 | U | 9/2013 |
| GB | 2 040 220 | A | 8/1980 |
| JP | 11 011437 | | 6/1997 |
| JP | 2006 198909 | | 1/2005 |
| JP | 2008 093997 | | 10/2006 |
| JP | 07 281738 | | 10/2007 |

* cited by examiner

METHOD AND APPARATUS FOR CONSTRUCTING FOLDED FLATS FOR HOUSING ABSORBENT ARTICLES

CROSS REFERENCE TO RELATED APPLICATIONS

This application claims the benefit of U.S. Provisional Application No. 62/163,409 filed on May 19, 2015, which is herein incorporated herein by reference.

FIELD OF THE INVENTION

The present disclosure relates to methods and apparatuses for packaging consumer goods, and more particularly, to methods and apparatuses for constructing containers for housing consumer goods such as absorbent articles.

BACKGROUND OF THE INVENTION

In some processes, fully assembled absorbent articles are packaged in containers for shipment and distribution to customers. Typically, the absorbent articles are packaged in primary packaging, for example, polybags, which are then placed into secondary packaging such as cardboard containers. The manufacturer may provide printed indicia on either or both of the primary packaging and secondary packaging, depending on which is intended to be the product ultimately purchased by a consumer. The cardboard container may be shipped to a retailer and placed on shelf, then a consumer purchases the container, takes it home, and then opens the container and disposes of it. Alternately, the consumer may purchase the container via e-commerce, for example, online through the internet, and the container is shipped directly to the consumer. In yet another alternative, the retailer may open the container and place the individual polybags of absorbent articles on a shelf for sale, and likely stack them to save space and/or to create a display. After taking the product home, the consumer typically opens the container, if any, and then opens the polybag containing the absorbent articles, removes all or some of the absorbent articles and then places them in yet another container such as a diaper bag or similar container attached or placed proximately to a changing table, from which they are retrieved at the point of use.

The containers for housing or containing the absorbent articles may be provided by a manufacturer. The containers are typically supplied in a flat configuration, referred to as flats. Further, these flats are supplied in a stack of several flats. Thus, upon visual inspection of the stack of flats it is difficult to identify which flats fail to meet acceptable quality standards. More specifically, one or more of the flats may have manufacturing defects that result in the container being unacceptable to house one or more absorbent articles. Defects may include, for example, the size of the panels and the gap between adjacent panels. However, because these defects are not immediately identifiable at the time the containers are supplied to the manufacturing line, a defective container may cause added cost and complexity to the manufacturing process. For example, removing a defective container from the manufacturing line may result in the line having to be stopped, which may be costly for manufacturers. In an additional example, a defective container may prove to be unacceptable for stacking product on store shelves or transporting product to suppliers.

Therefore, it would be desirable to provide a method and apparatus for identifying defective containers and/or correcting the issues of the defective containers prior to packaging the absorbent articles.

SUMMARY OF THE INVENTION

Aspects of the present disclosure include a method for folding a flat for housing absorbent articles. The method comprises the step of: providing a flat comprising a first surface and a second surface opposite the first surface, wherein the first surface comprises a first panel and a second panel, wherein each of the first panel and the second panel include an outer edge and an inner edge extending in a machine direction, and wherein the inner edge of the first panel and the inner edge of the second panel are separated by a first distance extending parallel to a cross direction, and wherein the first panel has a first panel length extending parallel to the cross direction and the second panel has a second panel length extending parallel to the cross direction, and wherein the first panel includes a first score line extending in the machine direction and a tab adjacent the first score line and connected to the second panel; advancing the flat in a machine direction to a first location; providing a fold apparatus; determining at least one of the first distance, the first panel length, and the second panel length with a visual detection device positioned adjacent the fold apparatus at the first location; adjusting the fold apparatus based on the first distance; engaging the first surface of the flat with the fold apparatus; adjusting one or more downstream processes based on the first panel length and the second panel length; folding the flat along the first score line to construct a folded flat; and placing the folded flat in the second location.

Aspects of the present disclosure include a method of folding a flat for housing absorbent articles. The method comprises the steps of: providing a flat comprising a first surface and a second surface opposite the first surface, wherein the first surface comprises a first panel and a second panel, wherein each of the first panel and the second panel include an outer edge and an inner edge extending in a machine direction, and wherein the inner edge of the first panel and the inner edge of the second panel are separated by a first distance, and wherein the first panel includes a first score line extending in the machine direction and a tab adjacent the first score line and connected to the first panel; providing a fold apparatus comprising a first engagement member, a second engagement member, and a fold assist member, wherein the first engagement member comprises a receiving surface and a plane of the receiving surface is parallel with a plane of the first surface of the flat, and wherein the second engagement member comprises a press surface and the press surface is configured to move from a first configuration to a second configuration; advancing the flat in a machine direction to a first location; evaluating the first surface of the flat using a visual detection device positioned adjacent the fold apparatus at the first location; determining the first distance; engaging a portion of the first panel and the press surface; engaging a portion of the second panel and the receiving surface; advancing the flat to a second location; engaging the fold assist member when the first distance is greater than a predetermined distance, wherein the fold assist member is movably positioned between the inner edge of the first panel and the inner edge of the second panel; engaging the second engagement member wherein the first distance is greater than, less than, or equal to the predetermined distance, wherein the second engagement member extends about an arcuate pathway; and folding the flat along the first score line such that the first panel is substantially perpendicular to the second panel.

Aspects of the present disclosure include a taping apparatus for applying a continuous length of tape to a container for containing absorbent articles. The apparatus includes a support member having a leading edge portion, a trailing edge portion opposite the leading edge portion, an inboard edge portion, an outboard edge portion opposite the inboard edge portion, a first surface, and a second surface opposite the first surface. The apparatus may also include a first engagement member including one or more receiving members attached to the first surface of the support member. Each of the one or more receiving members may include a receiving surface, and an arcuate arm positioned adjacent the outboard edge portion of the support member. The arcuate arm may include one or more press members. Each of the one or more press member may include a press surface. The arcuate arm may be configured to position the one or more press members in a first configuration and a second configuration. The apparatus may also include a fold assist member positioned adjacent the outboard edge portion of the support member. The fold assist member may include a first fold fin adjacent the leading edge portion of the support member and a second fold fin adjacent the trailing edge portion of the support member. The first fold fin has a first longitudinal fin axis and the second fold fin has a second longitudinal fin axis. The first longitudinal fin axis forms a first engagement angle with a plane of the receiving surface and the second longitudinal fin axis forms a second engagement angle with the plane of the receiving surface. Further, a pressure source may be operatively connected to the fold assist member. The pressure source may be configured to engage and disengage each of the first fold fin along the first longitudinal fin axis and the second fold fin along the second longitudinal fin axis.

DETAILED DESCRIPTION OF THE INVENTION

The following definitions may be useful in understanding the present disclosure.

"Absorbent article" is used herein to refer to consumer products whose primary function is to absorb and retain soils and wastes. Absorbent articles may include disposable diapers, pads, and the like. "Diaper" is used herein to refer to an absorbent article generally worn by infants and incontinent persons about the lower torso of the wearer.

"Machine direction" (MD) refers herein to the direction of material flow through a process. In addition, relative placement and movement of material can be described as flowing in the machine direction through a process from upstream in the process to downstream in the process.

"Cross direction" (CD) refers herein to a direction that is not parallel with, and usually perpendicular to, the machine direction.

The present disclosure relates to methods and apparatuses for packaging consumer goods, and more particularly, to methods and apparatuses for constructing containers for housing consumer goods such as absorbent articles. A container may be constructed from a flat. The flat may include a first surface and a second surface opposite the first surface. The first surface may include a first panel and a second panel. Each of the first panel and the second panel include an outer edge and an inner edge that each extend in a machine direction. The inner edge of each of the first panel and the second panel may be separated by a first distance extending in a cross direction. Further, the first panel may include a first score line that extends in the machine direction and a tab adjacent the first score line. The tab connects the first panel and the second panel. A folding apparatus may be configured to engage the first surface of the flat. More specifically, the folding apparatus may include an engagement member and a fold assist member. The engaging member may be configured to engage a portion of the first surface of the flat. Further, the fold assist member may be configured to engage the area between the inner edge of the first panel and the inner edge of the second panel. The engaging member and the fold assist member cooperate fold the flat along the score line to form a folded flat. The cooperation of the engaging member and the fold assist member ensure that the flat is folded along the score line and, thus, aid in constructing a container that can be used in downstream processes. The aforementioned will be described in detail herein.

While the present disclosure discusses constructing a container for housing absorbent articles, it is to be appreciated that the methods and apparatuses disclosed herein may be used to construct containers for containing various other consumer products such as paper towel, toilet paper, wipes, cosmetics, detergents, skin care products, pharmaceutical products, and the like.

Figure 1:
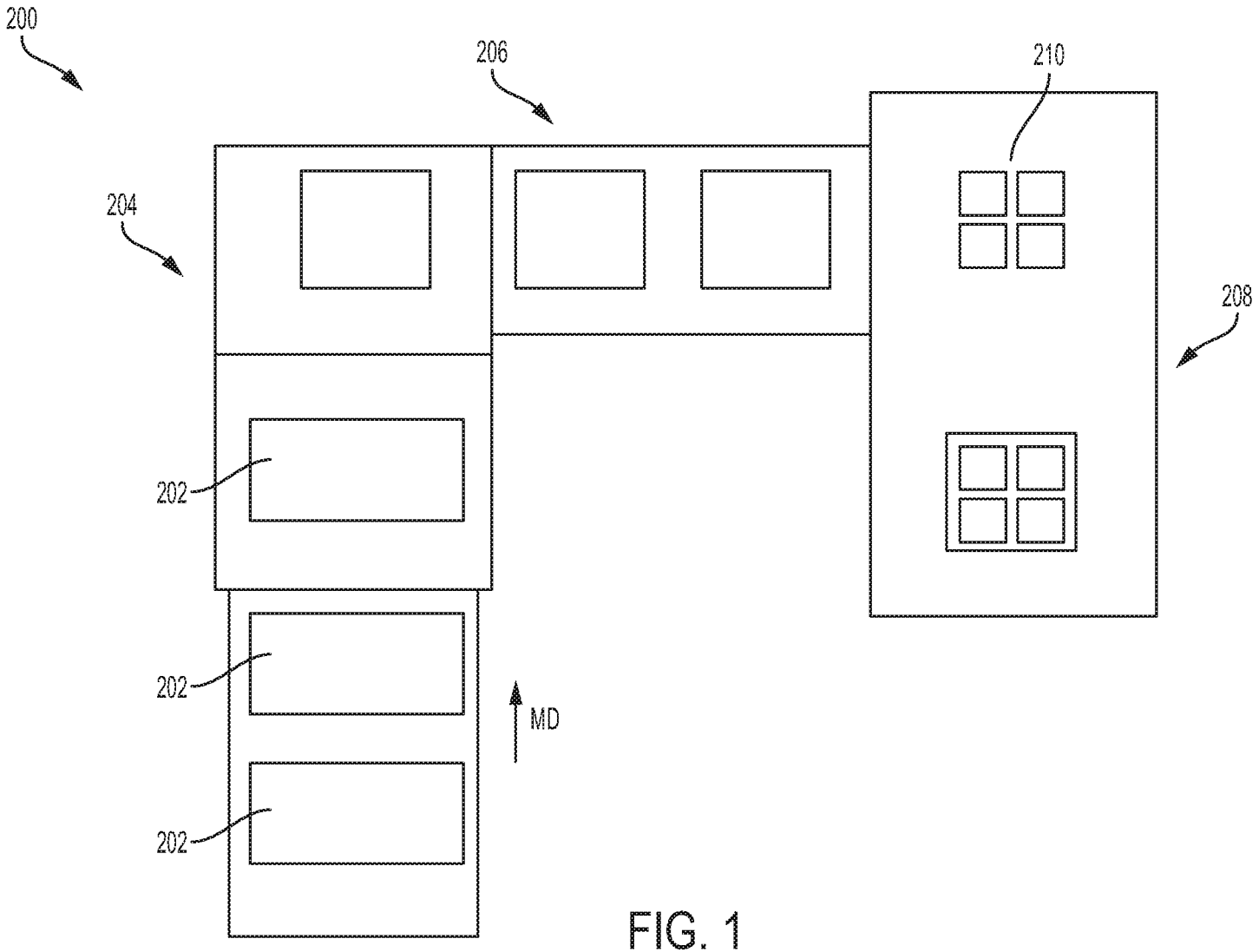
FIG. 1 is a top, schematic representation of a processes for packaging absorbent articles in accordance with one non-limiting embodiment of the present disclosure.

FIG. 1 illustrates an overview of the process for packaging 200 one or more absorbent articles in a container. A plurality of flats 202 may be provided. The plurality of flats 202 may be provided in a stack of one or more flats. The plurality of flats 202 may be advanced in the machine direction MD toward the flat assembly area 204. In the flat assembly area 204, the flat is folded to form a folded flat. The folded flat may be placed on a transfer member in a transfer and assembly area 206. In the transfer and assembly area 206, the folded flat may undergo additional folding and additional materials, such as tape, glue, or other similar adhesives, may be applied to the folded flat. The folded flat may be advanced to a packing area where an assembly of absorbent articles 210 may be disposed within the folded flat. Once the absorbent articles 210 or other consumer products have been placed within the folded flat, the folded flat may be sealed forming a container. The container housing the absorbent articles may then advance to other downstream processes.

Figure 2:
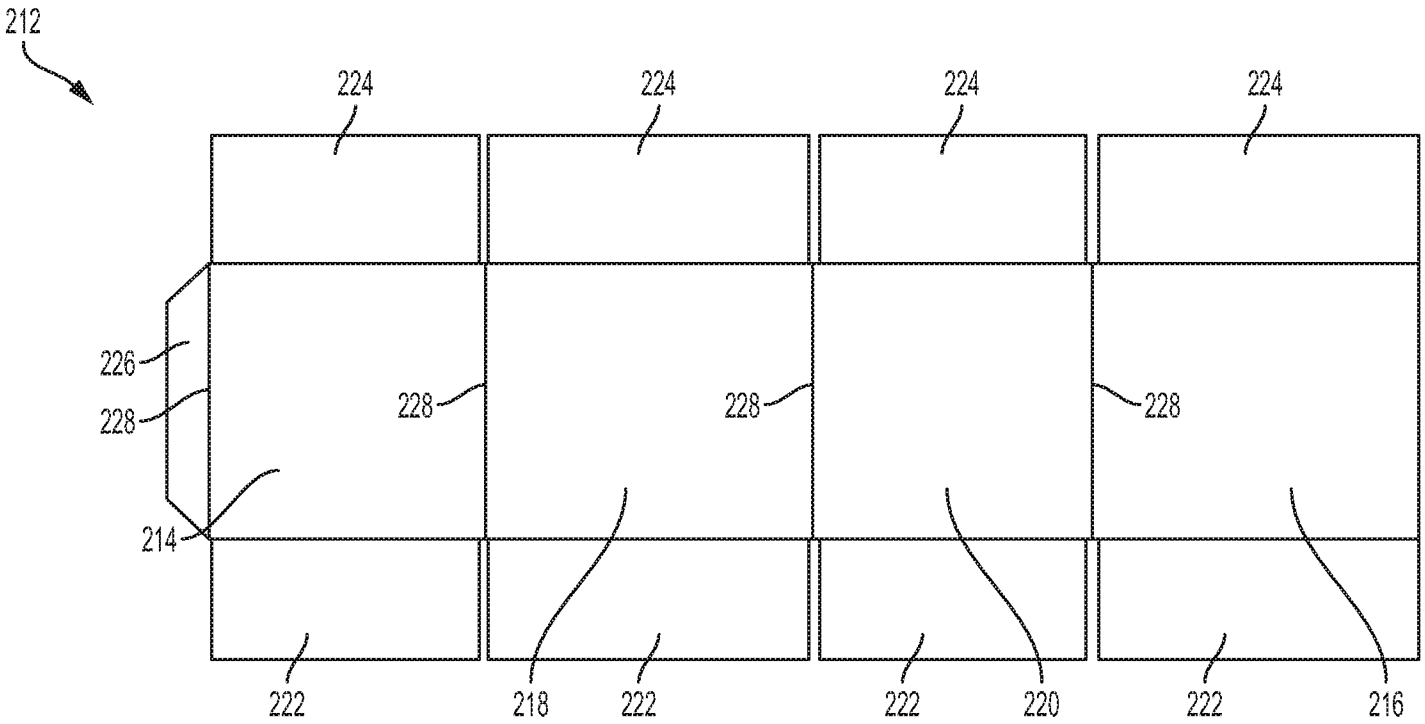
FIG. 2 is a top view of an unassembled flat in accordance with one non-limiting embodiment of the present disclosure.

FIG. 2 is an exemplary embodiment of an unassembled flat 212. The unassembled flat 212 may include a first panel 214, a second panel 216 opposite the first panel, a third panel 218 adjacent the first panel 214, and a fourth panel 220 between the third panel 218 and the second panel 216. Each panel may include a first side flap 222 and a second side flap 224. Further, the unassembled flat 212 may include a tab 226 that extends from an edge of the first panel 214. The unassembled flat 212 may also include one or more score lines 228 along which the unassembled flat 212 may be folded. The score lines 228 may be positioned between each panel. A score line 228 may be any line along which the unassembled flat 212 is intended to fold along.

Figure 3A:
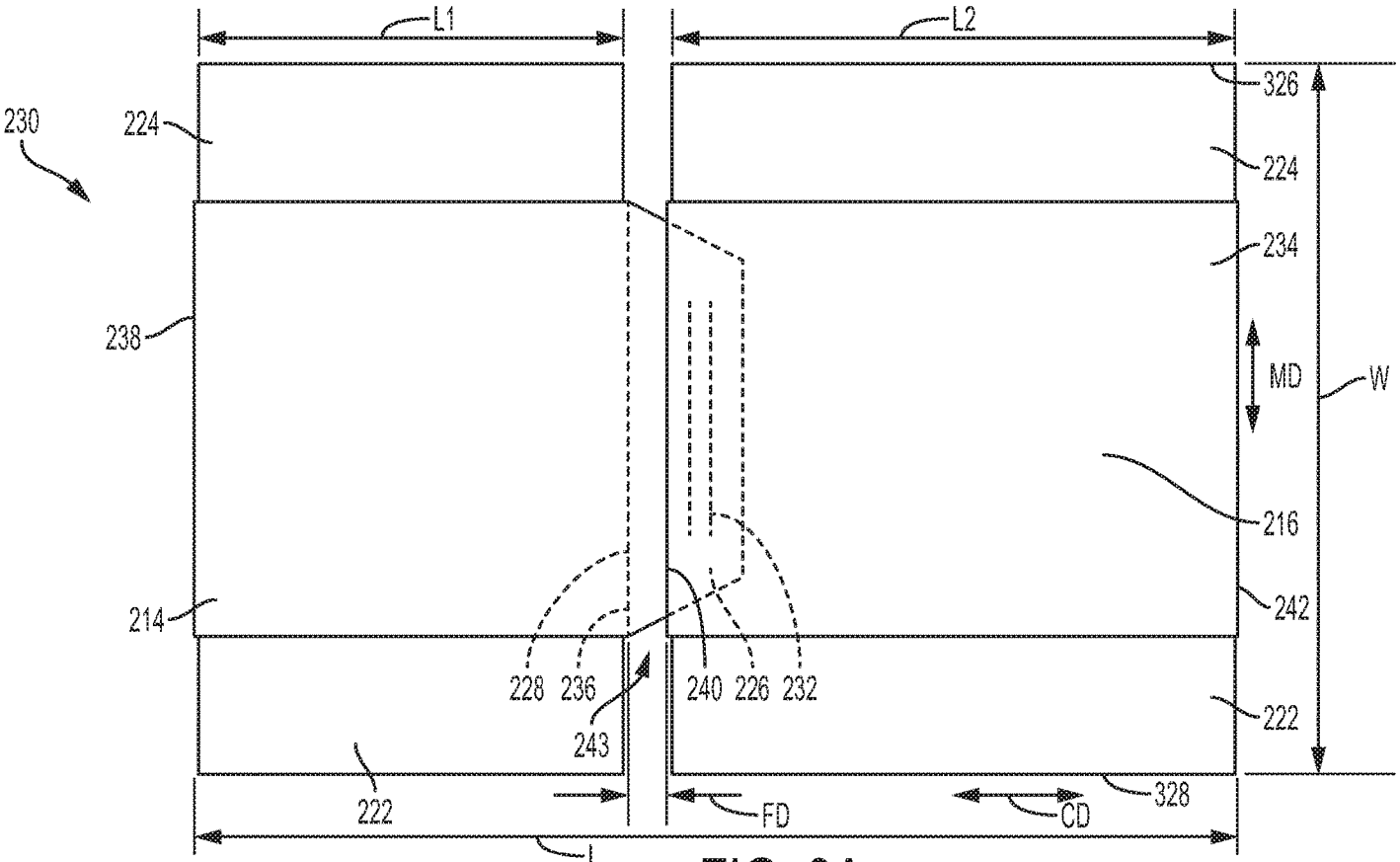
FIG. 3A is a top is a top view of a first surface of a flat in accordance with one non-limiting embodiment of the present disclosure.
Figure 3B:
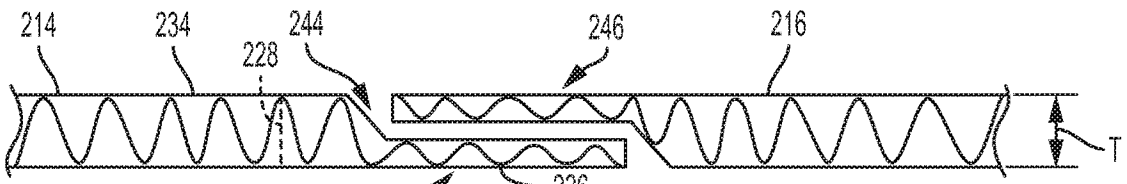
FIG. 3B is a partial side view of a first panel and a second panel of a flat in accordance with one non-limiting embodiment of the present disclosure.

Prior to being supplied to the flat assembly area 204, the unassembled flat 212 may be partially assembled, as illustrated in FIGS. 3A and 3B, into a flat 230. More specifically, the unassembled flat 212 may be folded along the score line 228 positioned between the first panel 214 and the third panel 218 and along the score line 228 positioned between the second panel 216 and the fourth panel 220. Further, the tab 226, which extends from an edge of the first panel 214, may be attached to a portion of the second panel 216. The tab 226 and the portion of the second panel 216 may be attached chemically or mechanically. For example, the tab 226 may be attached by clamps, staples, or other mechanical devices and/or chemically attached by adhesives such as glue or another chemical substance with adhesive properties. As illustrated in FIG. 3A, the tab 226 may be attached by one or more strips of adhesive 232.

Figure 4A:
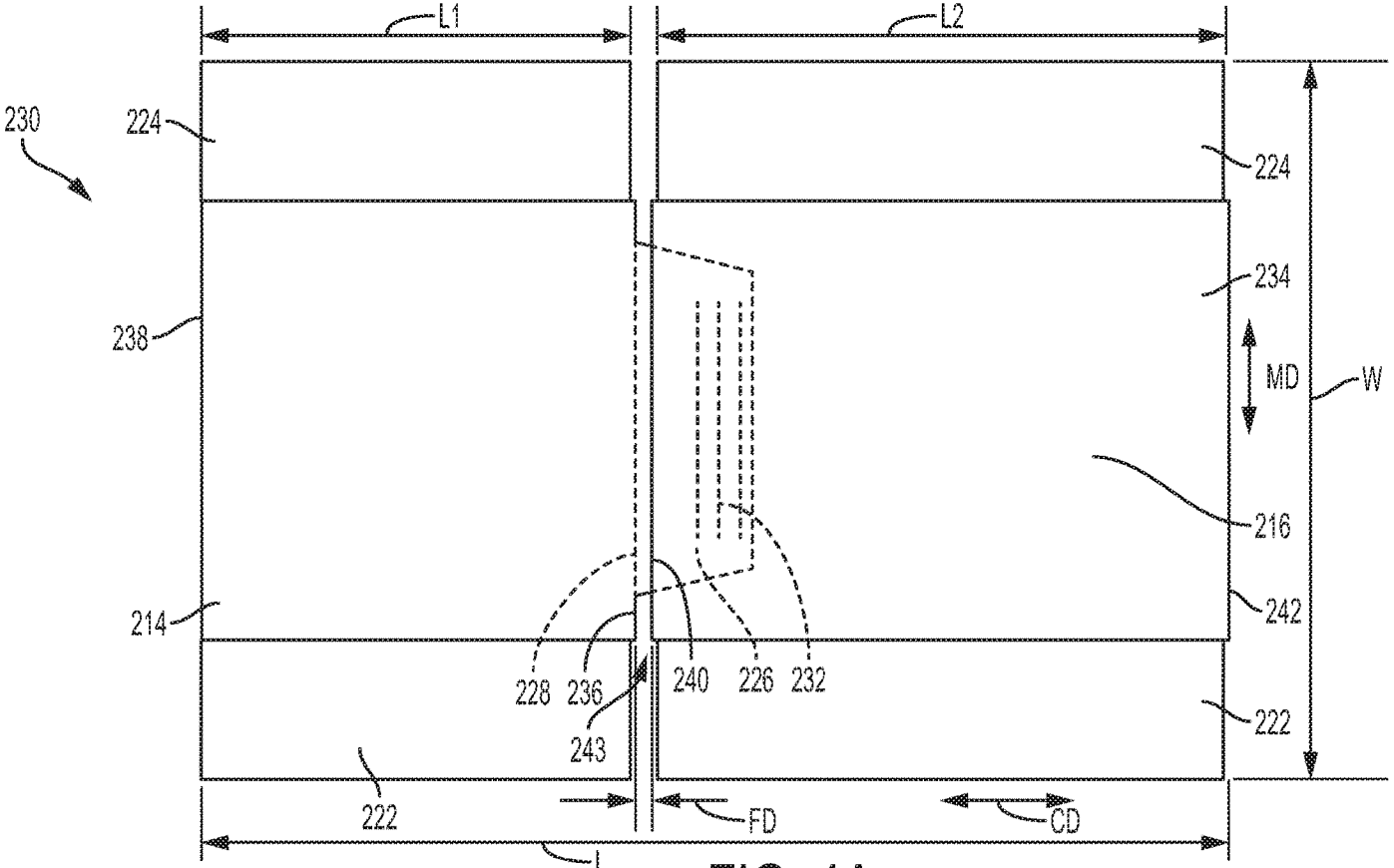
FIG. 4A is a top is a top view of a first surface of a flat in accordance with one non-limiting embodiment of the present disclosure.

A flat 230, as illustrated in FIGS. 3A and 4A, may include a first surface 234 and a second surface (not shown). The first surface 232 may include the first panel 214 and the second panel 216. Similarly, the second surface may include the third panel 218 and the fourth panel 220. The first panel 214 includes an inner edge 236 and an outer edge 238, opposite the inner edge 236. The second panel 216 includes an inner edge 240 and an outer edge 242, opposite the inner edge 240. Each of the inner edges 236, 240 and the outer edges 238, 242 may extend in a direction substantially parallel to the machine direction MD. The first panel 214 may include a first panel length L1 measured between and perpendicular to the first panel inner edge 236 and the first panel outer edge 238. The second panel 216 may include a second panel length L2 measured between and perpendicular to the second panel inner edge 240 and the second panel outer edge 242. The inner edge 236 of the first panel 214 may be separated from the inner edge 240 of the second panel 216 by a gap 243 having a first distance FD. The first distance FD is measured parallel to the cross direction CD between each inner edge 236, 240. The FD may change based on the overlap between the tab 226 and the second panel 216. For example, the FD shown in FIG. 3A is different from the FD shown in FIG. 4A.

The flat 230 may also include a width W that extends in a direction substantially parallel to the machine direction MD from a leading edge 326 to a trailing edge 328. The flat 230 may also include a length L that extends in a direction substantially perpendicular to the machine direction MD from the outer edge 238 of the first panel 214 to the outer edge 242 of the second panel 216.

Figure 4B:
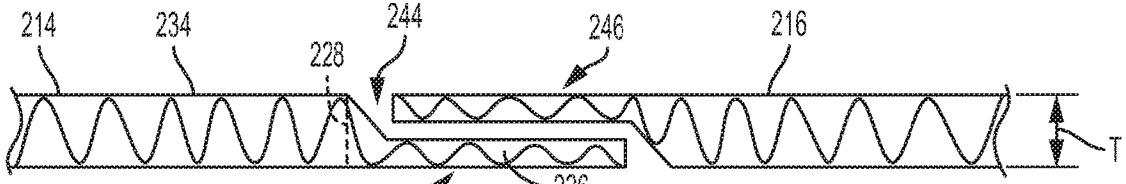
FIG. 4B is a partial side view of a first panel and a second panel of a flat in accordance with one non-limiting embodiment of the present disclosure.

FIGS. 3B and 4B illustrate a side view of a portion of the first panel 214 and the second panel 216 of the flat 230. A portion of the tab 226 and a portion of the second panel 216 overlap to form an overlap portion 246. As illustrated, in some embodiments, the overlap portion 246 may be compressed during the assembly of the flat 230. Thus, the overlap portion 246 may be substantially the same thickness T as at least one of the first panel 214 and the second panel 216. Alternatively, a portion of the second panel 216 may be compressed prior to being attached to the tab 226. Similarly, the tab 226 may be compressed prior to being attached to the second panel 216. Thus, the tab 226 and a portion of the second panel 216 may be thinner than another portion of the second panel 216. Overall, the thickness of the portion of the second panel 216 attached to the tab 226 may be substantially the same as the thickness of the first panel 214 and/or the other portion of the second panel 216. However, it is to be appreciated that the overlap portion 246 may be thicker than at least one of the first panel 214 and the second panel 216. The tab 226 and/or the portion of the second panel 216 configured to engage the tab 226 may not undergo any compression prior to engagement or while engaged. Due to the configuration of the tab 226 and the second panel 216, an area of weakness 244 may be formed. This area of weakness 244 may be formed in part due to the application of the adhesive, the overlap between the tab 226 and the portion of the second panel 216, and/or the compressed or thinner construction of the tab 226 and/or the portion of the second panel 216. Thus, when the flat 230 is being folded, there are two areas along which the flat 230 may be inclined to fold, the score line 228 or the area of weakness 244.

Figure 5B:
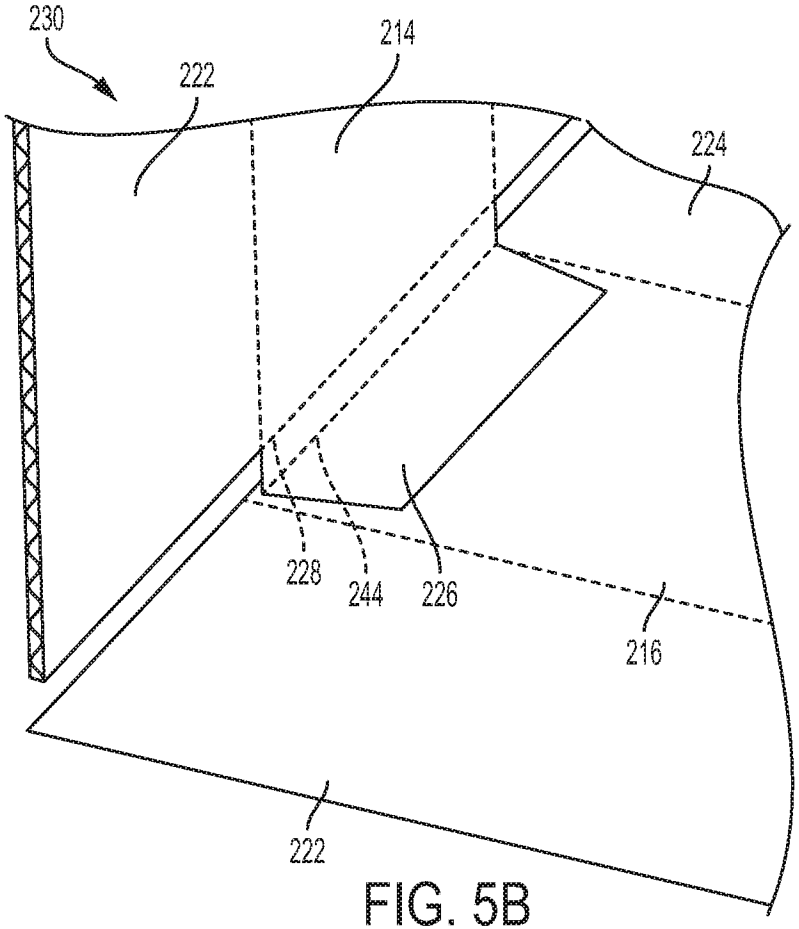
FIG. 5B is a partial perspective view of a flat folded along an area of weakness in accordance with one non-limiting embodiment of the present disclosure.
Figure 5A:
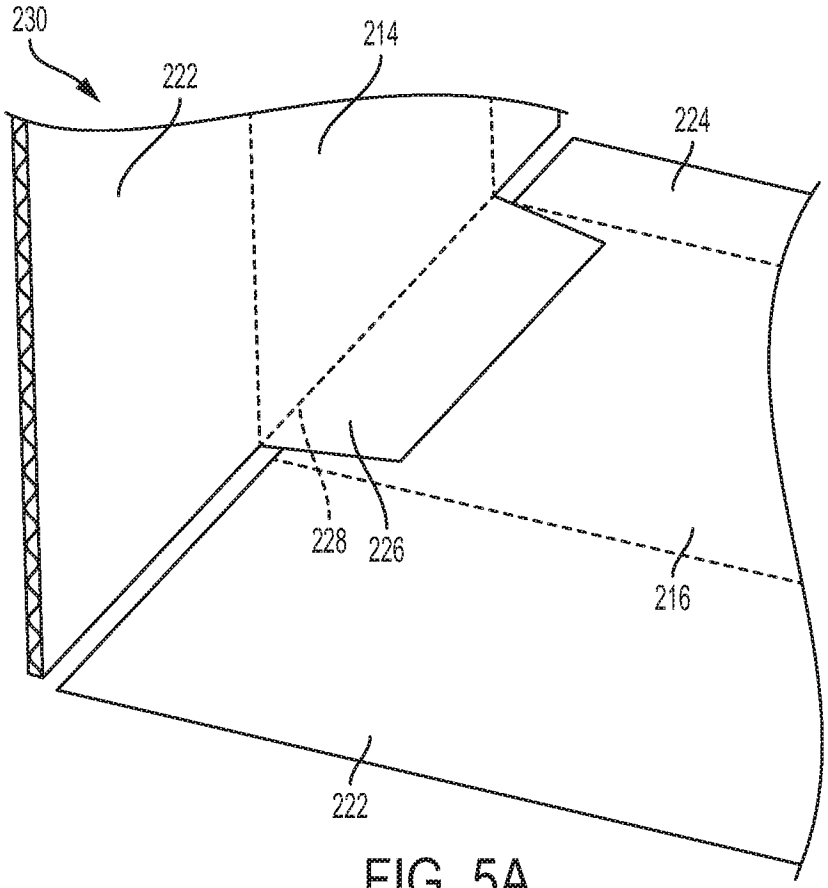
FIG. 5A is a partial perspective view of a flat folded along a score line in accordance with one non-limiting embodiment of the present disclosure.

When the flat 230 is folded, it is desired to have the flat 230 fold along the score line 228. However, there are instances when the flat does not fold along the score line 228, but instead, folds along the area of weakness 244. FIGS. 5A and 5B illustrate a portion of the flat 230 in a folded configuration. FIG. 5A illustrates the flat 230 folded along the score line 228, which is the desired area along which the flat is to fold. FIG. 5B illustrates the flat 230 folded along the area of weakness 244, which is an unintended area along which the flat may fold. When the flat 230 is folded, it is to be appreciated that the line along which the flat 230 is folded is as close as possible to the score line 228. The farther the flat 230 is folded away from the score line 228, the greater likelihood that the flat 230 will be asymmetrical and unable to be used in downstream processing. Thus, to control where the flat 230 is folded a fold apparatus 250 may be used.

Figure 6:
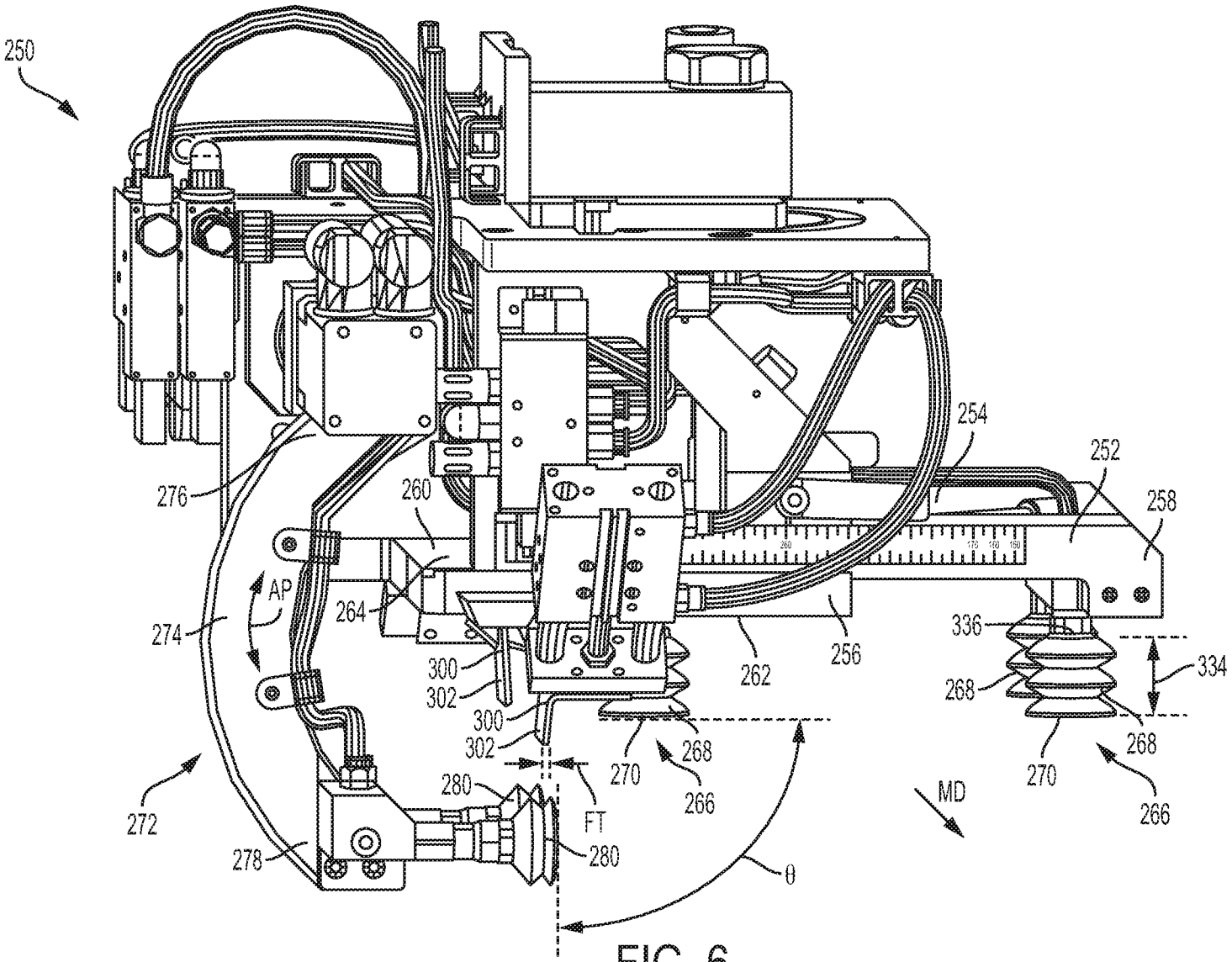
FIG. 6 is a perspective view of a fold apparatus in accordance with one non-limiting embodiment of the present disclosure.

Referring to FIG. 6, the fold apparatus 250 may include a support member 252. The support member 252 includes a leading edge portion 254, a trailing edge portion 256 opposite the leading edge portion 254, an inboard edge portion 258, and an outboard edge portion 260 opposite the inboard portion 258. The inboard edge portion 258 and the outboard edge portion 260 may each extend in a direction substantially parallel to the machine direction MD. The leading edge portion 254 and the trailing edge portion 256 may each extend in a direction substantially perpendicular to the machine direction MD. Further, as the fold apparatus 250 advances in the machine direction MD, the leading edge portion 254 may advance first and the trailing edge portion 256 may follow the leading edge portion 254. Further, the support member 252 may include a first surface 262 and a second surface 264 opposite the first surface 262. The first surface 262 may be in facing relationship with the first surface 234 of the flat 230. It is to be appreciated that the support member 252 may be a single unitary member or may include one or more members.

The folding apparatus 250 may also include a first engagement member 266. The first engagement member 266 may include one or more receiving members 268 attached to the first surface 262 of the support member 252. Each of the one or more receiving members 268 includes a receiving surface 270. The receiving surface 270 may be a substantially planar surface that is configured to engage a portion of the first surface 234 of the flat 230. Each receiving member 268 may be fluidly connected to a vacuum source (not shown). The vacuum source may move fluid, such as air, such that the when the receiving surface 270 engages the first surface 234 of the flat 230, the flat 230 may be picked up and held by the receiving members 268. The flat 230 may then move in at least one of the cross direction and the machine direction with the folding apparatus 250. Stated another way, the vacuum source allows the receiving member 266 to apply an upward force on the flat 230 causing the flat 230 to remain engaged with the receiving surface 270 of the receiving member 268. Further, the vacuum source may be controlled such that the vacuum source provides the desired suction to hold the flat 230 against the receiving surface 270 and, subsequently, releases the flat 230, by turning off or providing a desired pressure force against the flat 230. The receiving member 268 may be a suction type device having a substantially circular cross section. It is to be appreciated that each receiving member 268 may be any shape that can engage with the first surface 234 of the flat 230.

The receiving member may expand and compress as the vacuum source moves air to engage the flat 230 and disengage the flat 230. More specifically, each receiving member 268 may include a receiving member height 334 measured from the receiving surface 270 to the proximal end portion 336, which is opposite the receiving surface 270, of the receiving member 268. The receiving member height 334 may increase as the flat 230 is disengaged or released from the receiving surface. The receiving member height 334 may decrease as the flat 230 is engaged or accepted onto the receiving surface 270. It is to be appreciated that each receiving member may expand and/or compress such that each receiving surface 270 of each receiving member 268 is planar.

The folding apparatus 250 may include a second engagement member 272 positioned adjacent the first engagement member 266. The second engagement member 272 may include an arcuate arm 274 positioned adjacent the outboard edge portion 260 of the support member 252. The arcuate arm 274 may include a proximal end portion 276 and a distal end portion 278 opposite the proximal end portion 276. The proximal end portion 276 of the arcuate arm 274 may be operatively connected to a motor. The motor may be any device that transmits rotational energy to the proximal end portion of the arcuate arm 274. The motor may be operatively linked or operatively engaged with the arcuate arm using any technique known to those skilled in the art such as, for example, a gear to gear connection, transmission belting and pulleys, gearboxes, direct couplings, and the like or any combination thereof.

The distal end portion 278 of the arcuate arm 274 may include one or more press members 280. The press members 280 may extend from the distal end portion 278 of the arcuate arm 274. Each of the one or more press members 280 may include a press surface 282. The press surface 282 may be configured to engage a panel of the flat 230. The press member 280 may have a substantially circular cross section. However, it is to be appreciated that the press member 280 may have a cross section of any shape that allows the press member 280 to engage a panel of the flat 230. The arcuate arm 274 may be configured to traverse about a radial pathway, as indicated by arrow AP. More specifically, the arcuate arm 274 may traverse from a first configuration to a second configuration. In the first configuration, the arcuate arm 274 may rotate about the radial pathway AP such that the press surface 282 is substantially parallel with the cross direction CD. Stated another way, in the first configuration, the press surface 282 may be substantially parallel with the receiving surface 270. Thus the press surface 282 and the receiving surface 270 may be substantially planar. While positioned in the first configuration, the press members 280 may be configured to engage the first surface 234 of the flat 230. More specifically, the press members 280 may engage one of the first panel 214 or the second panel 216 of the flat 230. The press members 280 may be fluidly connect to a vacuum source. The vacuum source for the press members 280 and the receiving members 268 may be a single vacuum source or multiple, separate vacuum sources. The vacuum source allows the press member 280 to apply an upward force on the flat 230 causing the flat 230 to remain engaged with the press surface 282 of the press member 280. Further, the vacuum source may be controlled such that the vacuum source provides the desired suction to hold the flat 230 against the press surface 282 and, subsequently, releases the flat 230, by turning off or providing a desired pressure to aid in the release of the flat 230.

In the second configuration, as illustrate in FIG. 6, the arcuate arm 274 traverses about the radial pathway AP such that the press surface 282 is substantially perpendicular to the receiving surface 270. It is to be appreciated that the arcuate arm 274 may traverse any distance about the radial pathway AP. Thus, the press surface 282 may be at an arm angle θ with respect to the receiving surface 270. The arm angle may be from about 180 degrees to about 90 degrees. The movement of the arcuate arm 274 from the first configuration to the second configuration, aids in folding the flat 230, which will be described in more detail herein.

Figure 7:
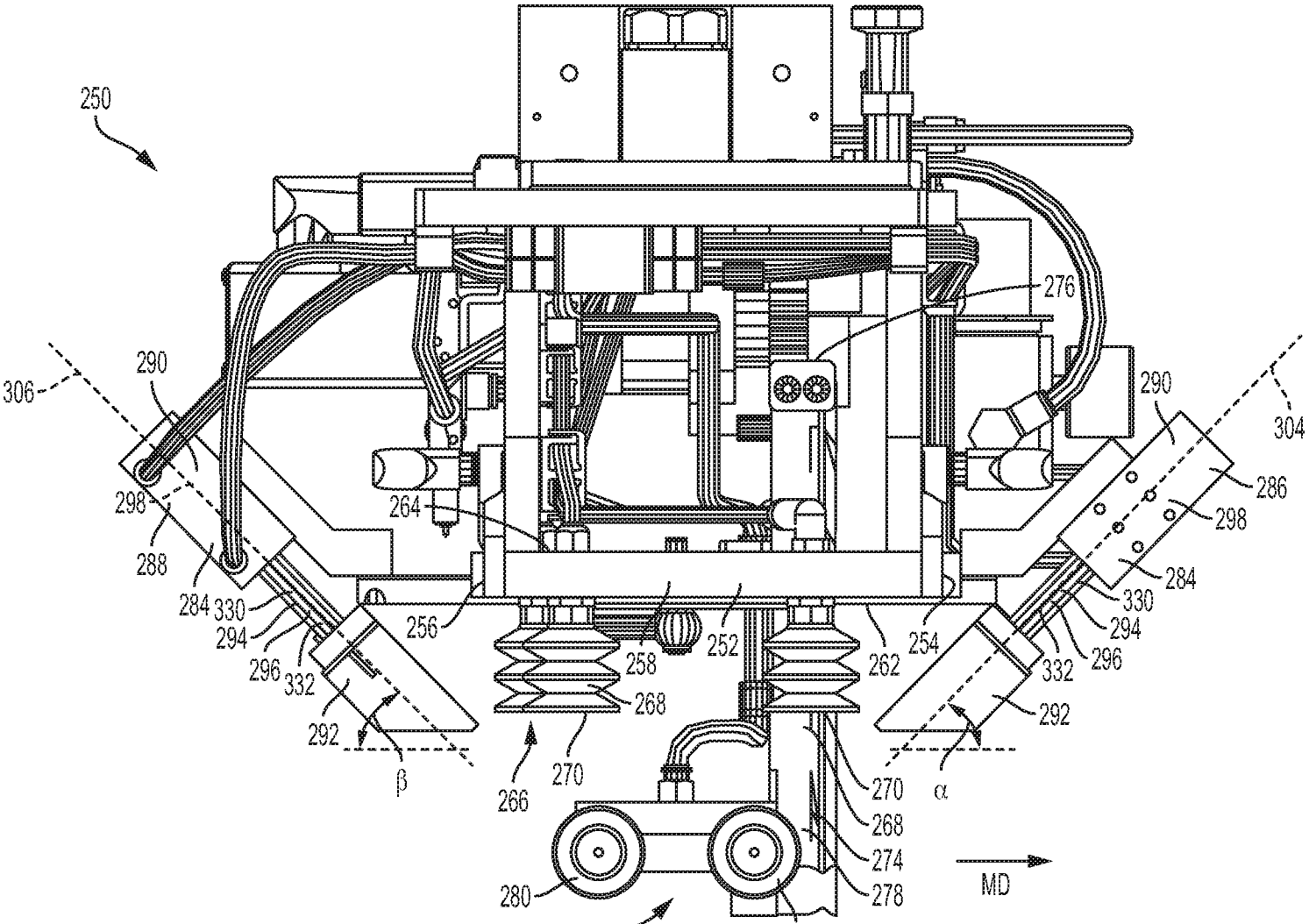
FIG. 7 is a side view of a fold apparatus in accordance with one non-limiting embodiment of the present disclosure.

The fold apparatus 250 may include one or more fold assist members 284. The fold assist member 284 may be positioned adjacent the outboard edge portion 258 of the support member 252. The fold apparatus 250 may include a first fold assist member 286 and a second fold assist member 288. The first fold assist member 286 may be positioned adjacent the leading edge portion 254 of the support member 252 and the second fold assist member 288 may be positioned adjacent the trailing edge portion 256 of the support member 252, as illustrated in FIG. 7. Each fold assist member 284 may include a proximal end portion 290, a distal end portion 292 opposite the proximal end portion, and a central portion 294 between the proximal end portion 290 and the distal end portion 292. The proximal end portion 290 of the fold assist member 284 may be fluidly connected to a pressure source. The pressure source may be configured to supply a fluid, such as air, at a pressure of from about 0.5 to about 3.5 bar and/or from about 1.5 to about 3.0 bar and/or from about 1.0 to about 2.5 bar, including all 0.1 increments therebetween. The proximal end portion 290 may also include one or more release valves to discharge the pressurized fluid.

The central portion 294 of the fold assist member 284 may include a rigid member 296. The rigid member 296 may include a first end portion 330 and a second end portion 332, opposite the first end portion 330. The rigid member 296 may be configured to retract and extend based on the supply of pressurized fluid and the discharge of the pressurized fluid. More specifically, the proximal end portion 290 of the fold assist member 284 may include a pressure chamber 298. The pressure chamber 298 may include an inlet for the pressurized fluid to be supplied. Further, the pressure chamber 298 may include one or more release valves to discharge the pressurized fluid. Further still, the pressure chamber 298 may include one or more apertures through which the first end portion 330 of the one or more rigid members 296 may extend and retract (also referred to herein as engaging and disengaging the rigid member 296). When the pressure source supplies the pressurized fluid to the pressure chamber 298, the first end portion 330 of the rigid member 296 may extend through the aperture of the pressure chamber toward the first engagement member 266. Subsequently, the pressurized fluid may be discharged causing the rigid member 296 to retract through the aperture away from the first engagement member 266.

The fold assist member 284 may also include a fold fin 300 positioned at the distal end portion 292 of the fold assist member 284. Further, the fold fin 300 may be attached to the second end portion 332 of the rigid member 296. Thus, the fold fin 300 may be configured to extend and retract with the rigid member 296. The fold fin 300 may be used to aid in folding the flat 230. The fold fin 300 may be any shape such that the fold fin 300 may extend between the inner edge 236 of the first panel 214 and the inner edge 240 of the second panel 216. The fold fin 300 may also include a substantially planar surface 302 against which a panel of the folded flat may be supported against, as illustrated in FIG. 6.

Referring to FIG. 7, each of the first fold assist member 286 and the second fold assist member 288 may include longitudinal fin axis. More specifically, the first fold assist member 286 may include a first longitudinal fin axis 304 and the second fold assist member 288 may include a second longitudinal fin axis 306. Each of the rigid members 296 and the fold fins 300 of the first fold assist member 286 and the second fold assist member 288 traverse along the first longitudinal fin axis 304 and the second longitudinal fin axis 306, respectively. Further, the first longitudinal fin axis 304 forms a first engagement angle $\alpha$ with respect to the machine direction MD and/or the plane of the receiving surface 270 of the receiving member 268. Similarly, the second longitudinal din axis 306 forms a second engagement angle $\beta$ with respect to the machine direction MD and/or parallel to the plane of the receiving surface 270 of the receiving member 268. The first engagement angle $\alpha$ and the second engagement angle $\beta$ each may be from about 25 degrees to about 85 degrees and/or from about 30 degrees to about 75 degrees and/or about 35 degrees and/or from about 40 degrees to about 65 degrees and/or from about 45 degrees to about 55 degrees, including all 0.1 increments therebetween.

Figure 8:
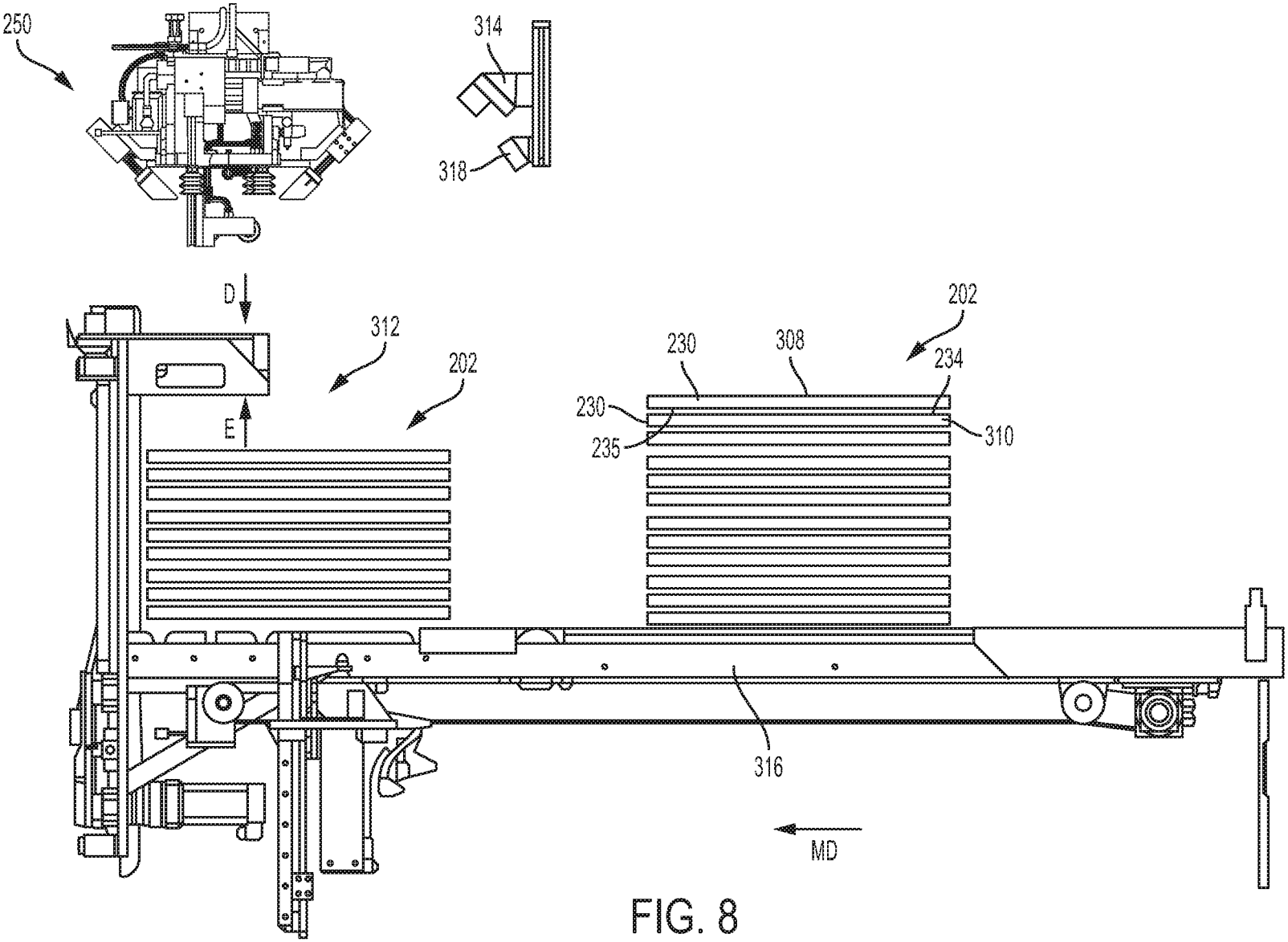
FIG. 8 is a side view of a plurality of flats disposed on a transfer apparatus and adjacent the fold apparatus in accordance with one non-limiting embodiment of the present disclosure.

As previously discussed, the flats 230 may be supplied to the manufacturing line as a plurality of flats 202 stacked one on top of one another. More specifically, the flats 230 may be stacked such that a second surface 235 of a first flat 308 is disposed on the first surface 234 of a second, adjacent flat 310, as illustrated in FIG. 8. The stack of the plurality of flats 202 that is to undergo folding may be advanced in the machine direction MD to a first location 312. The first location 312 may be downstream, in the machine direction MD, of a visual detection device 314. Further, the first location 312 may be adjacent to the fold apparatus 250. More specifically, the first location 312 is such that the fold apparatus 250 may engage one of the flats 230. The stack of the plurality of flats 202 may be advanced to the first location 312 by a transfer apparatus 316. The transfer apparatus 316 may be any device that may support the stack of plurality of flats 202 and move the flats in the machine direction MD. The transfer apparatus 316 may be a conveyor, a belt, or other similar transfer device. The transfer apparatus 316 may be powered by one or more motors, which may be any device that transmits rotational energy to the transfer apparatus 316.

The plurality of flats 202 may be positioned downstream of a visual detection device 314. The visual detection device 314 may be positioned adjacent the first surface 234 of the flat 230 farthest from the transfer apparatus 316. The visual detection device 314 may be moved horizontally, and in both the machine direction MD and cross direction CD such that the visual detection device is positioned to evaluate the first surface 234 of the flat 230. The visual detection device 314 may be used to evaluate the first distance FD, the length L extending in the cross direction CD of the first surface 234 of the flat 230, and/or the width W extending in the machine direction MD of the first surface 234 of the flat 230, as illustrated in FIGS. 3A and 4A. Further, the visual detection device 314 may also be used to evaluate the first panel length L1 and/or the second panel length L2. The visual detection device 314 may be used to evaluate any one or more of the aforementioned distances. To evaluate the aforementioned distances of the flat 230, the visual detection device 314 may capture an image of the first surface 234. Once the visual detection device 314 determines at least one of the length L, the width W, the first distance FD, the first panel length L1, and the second panel length L2, the visual detection device 314 may communicate the length L, the width W, the first panel length L1, the second panel length L2, and/or the first distance FD of the first surface 234 to the fold apparatus 250. Based on the information received from the visual detection device 314, the fold apparatus 250 may move in at least one of the machine direction MD and the cross direction CD so that the fold apparatus 250, and, more specifically, the fold assist member and the engagement member are in proper position to engage the first flat 230. Stated another way, the visual detection device 314 may determine the location of the gap 234, as illustrated in FIGS. 3A and 4A, and the fold apparatus 250 may be controlled such that the fold assist member is positioned to engage, if necessary, the gap 234 of the flat 230.

The visual detection device 314 may determine the first distance FD by measuring the first distance FD or from measuring the length L, the first panel length L1, and the second panel length L2. The visual detection device 314 may then compare the first distance FD against a predetermined distance. The predetermined distance is a value that may be input by a user. The predetermined distance may be based, in part, on the fin thickness FT of the fold fin 300 of the fold assist member 284, as illustrated in FIG. 6, and/or the desired spacing between the first panel 214 and the second panel 216. The predetermined distance may be greater than about 1 mm, greater than about 2 mm, greater than about 4 mm, greater than about 5 mm, or greater than about 6 mm, including all 0.1 mm increments. It is to be appreciated that the greater accuracy with which the fold apparatus 250 is positioned with respect to the gap 234 the smaller the predetermined distance may be. The visual detection device 314 communicates one or more dimensions, such as the first distance FD to a controller. The controller determines whether the first distance is greater than, less than, or equal to the predetermined distance. When the first distance is greater than the predetermined distance, during folding, the fold apparatus 250 causes the fold assist member 284, which may include the first fold assist member 286 and the second fold assist member 288, to pneumatically engage the flat. When the first distance is less than or equal to the predetermined distance, during folding, the fold apparatus 250 causes the fold assist member 284 to remain unengaged with the flat 230. Stated another way, the fold assist member does not pneumatically engage the flat 230 when the first distance FD is less than or equal to the predetermined distance.

The visual detection device 314 may evaluate the first surface 234 of the flat 230 in cooperation with an illumination source 318. The illumination source 318 may emit light such that the first surface 234 of the flat 230 is illuminated while the visual detection device 314 evaluates the first surface 234. The illumination of the first surface 234 may allow the visual detection device 314 to more easily and/or readily identify the features of the first surface of the flat, such as the outer edges and the inner edges. The type of light emitted from the illumination source 318 may depend, in part, on the surface of the flat. For example, if the first surface 234 of the flat 230 includes highly reflective graphics, the illumination source 318 may emit infrared light to minimize the impact of the reflective graphics. It is to be appreciated that other types of light such as ultraviolet and/or visible light may be used to illuminate the first surface 234 of the flat 230. It is also to be appreciated that the visual detection device 314 does not need to operate with the illumination source 318.

Figure 9:
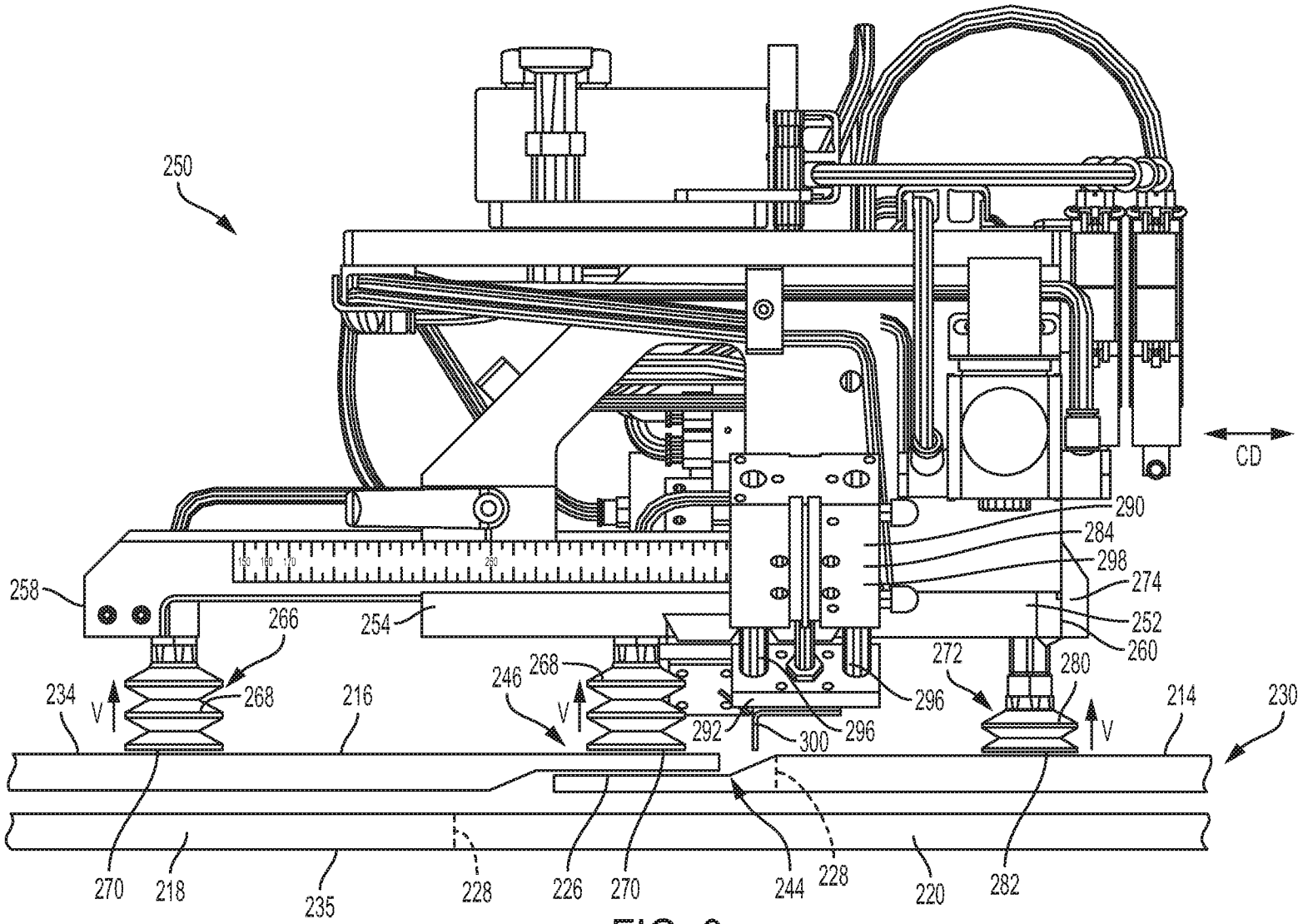
FIG. 9 is a front view of a fold apparatus engaged with a flat in accordance with one non-limiting embodiment of the present disclosure.

Once the visual detection device 314 and/or the illumination source 318 determine the first distance FD of the first surface 234 of the flat 230 and the location of the gap 234, the fold apparatus 250 may position itself to engage the first surface 234 of the flat 230. More specifically, the fold apparatus 250 may move in at least one of the machine direction MD and the cross direction CD. Once in the desired position, the fold apparatus moves toward the first surface of the flat as indicated by arrow D, illustrated in FIG. 8. Referring to FIG. 9, the fold apparatus 250 engages the first surface 234 of the flat 230. The receiving surface 270 of the receiving member 268 engages a portion of the first surface 234, such as the second panel 216. Further, the arcuate arm 274 is positioned in a first configuration such that the press surface 282 is substantially parallel to the receiving surface 270 and/or the first surface 234 of the flat 230. The press surface 282 of the press member 280 engages the first surface 234, such as the first panel 214. Each of the receiving member 268 and the press member 280 is pneumatically activated. Stated another way, the one or more vacuum sources direct fluid from each of the receiving surface 270 and the press surface 282 back to the one or more vacuum sources, as indicated by arrow V. The fluid pressure results in the first surface 234 engaging the press surface 282 and the receiving surface 270. The fluid pressure generated by the one or more vacuum sources may be strong enough to continue to hold the flat 230 while the fold apparatus 250 moves and folds the flat 230.

Once the flat 230 is engaged with the press surface 282 and the receiving surface 270. The fold apparatus 250 moves away from the plurality of flats 202, in a direction indicated by arrow E, as illustrated in FIG. 8. As the fold apparatus 250 moves in the direction indicated by arrow E, the arcuate arm 274 begins to traverse about the radial pathway AP, as illustrated in FIG. 6. As the arcuate arm 274 rotates, the first panel 214 begins to move from a substantially parallel position with respect to the cross direction CD and/or the second panel 216 of the flat 230 to a substantially perpendicular position with respect to the cross direction CD and/or with respect to the second panel 216 of the flat 230.

The fold assist member 284 may operate in cooperation with the arcuate arm 274. When the first distance is less than or equal to the predetermined distance, the fold assist member 284 is not pneumatically activated and the arcuate arm 274 may fold the flat 230 without the assistance of the fold assist member 284. When the first distance is greater than the predetermined distance, as the arcuate arm 274 traverses about the arcuate arm pathway AP, the fold assist member 284 is pneumatically activated and, thus, begins to extend along the longitudinal fin axis. It is to be appreciated that there may be one or more fold assist members 284. As previously described, each fold assist member may extend and retract (also referred to as engaging and disengaging) along a longitudinal fin axis.

Figure 10:
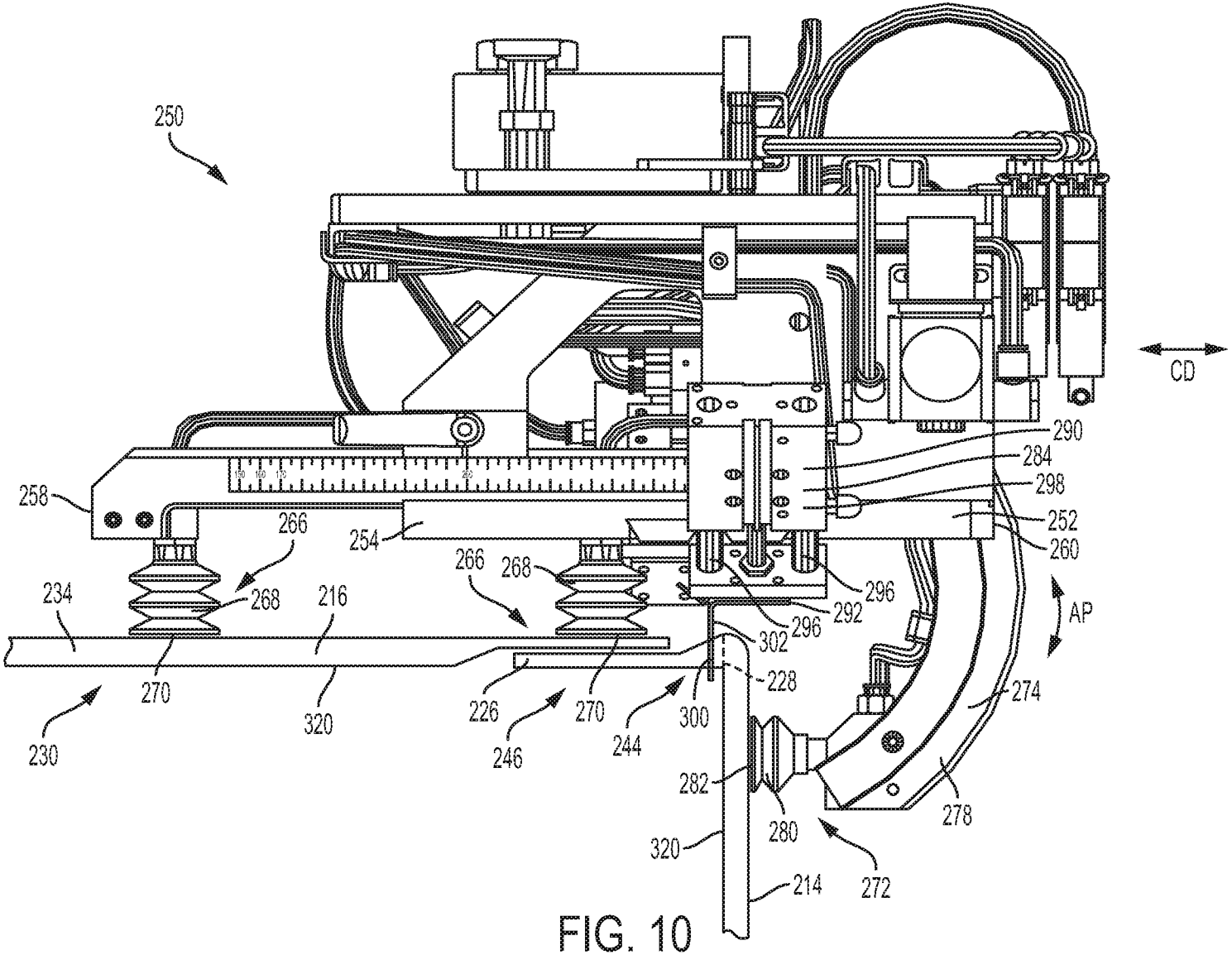
FIG. 10 is a front view of a fold apparatus engaged with a flat in accordance with one non-limiting embodiment of the present disclosure.

When the fold assist member 284 is pneumatically engaged, the fold fin 300 extends between gap 234, which is the area between the inner edge 236 of the first panel 214 and the inner edge 240 of the second panel 216. At least a portion of the fold fin 300 may be positioned within the interior portion 320 of the first panel 214 and the second panel 216, as illustrated in FIG. 10. The fold fin 300 may be extended to the position within the interior portion 320 of the first panel 214 and the second panel 216 such that when the first panel 214 is folded, a portion of the interior portion 320 of the first panel 214 may engage the planar surface 302 of the fold fin 300. The alignment of the fold apparatus 250 and, more specifically, the fold fin 300 with the score line 228, allows the flat to be folded along the score line 288 and, further, prevents the flat 230 from folding along any portion other than the score line 288, such as the area of weakness or along a strip of adhesive 232. As previously stated, ensuring that the flat 230 is folded along the score line 288 allows the flat 230 to be constructed into a container which may be used for downstream processes and prevents containers which are not square or not properly folded from causing down-time during the manufacturing processes or from shipping out-of-specification containers to consumers.

Figure 11:
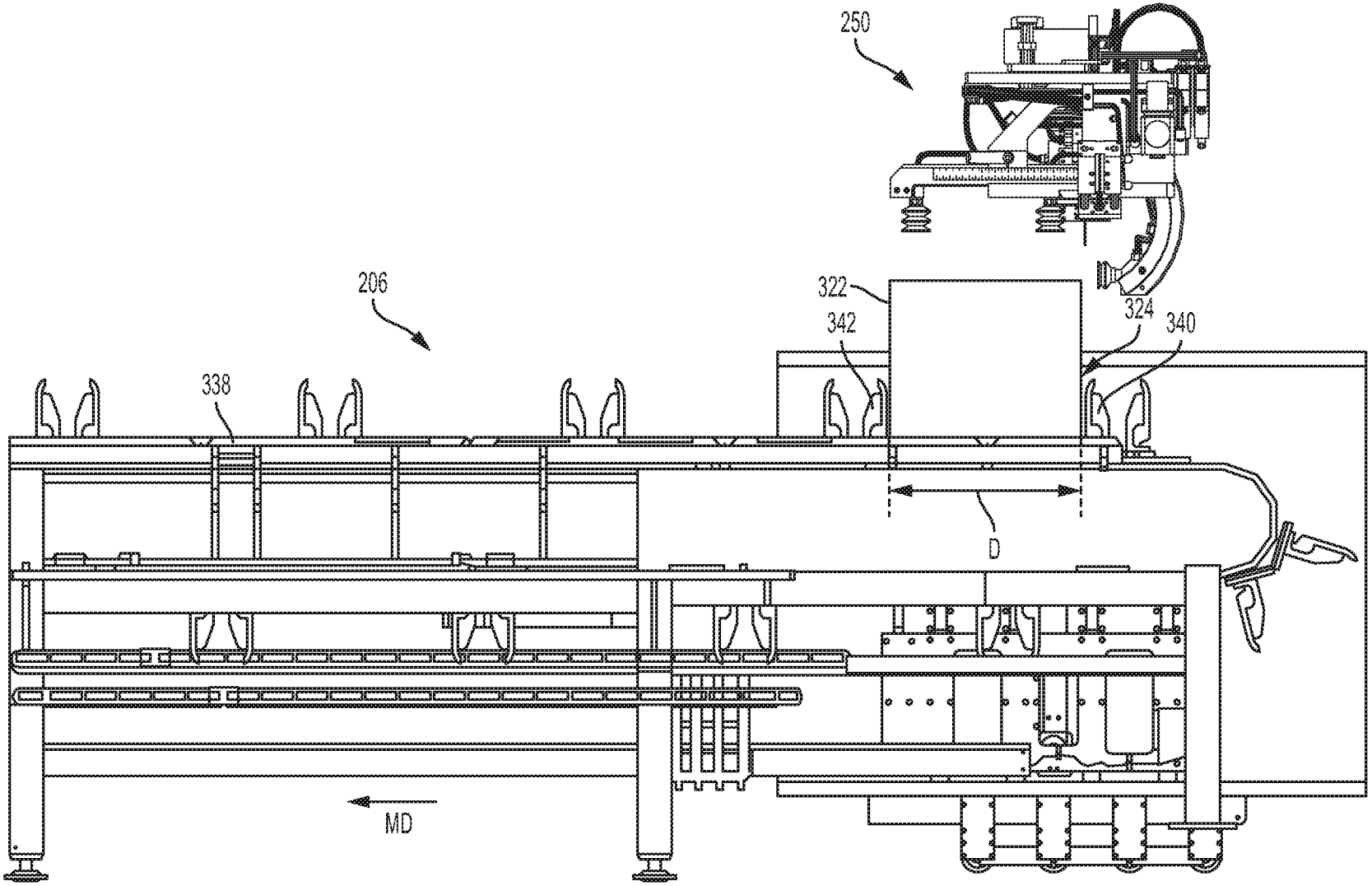
FIG. 11 is a front view of a folded flat in a second location in accordance with one non-limiting embodiment of the present disclosure.

The arcuate arm 274 continues to traverse about the arcuate arm pathway until the first panel 214 is substantially perpendicular to the second panel 216. It is to be appreciated that as the first panel 214 and the second panel 216 are folded along the score line 288, the third panel and the fourth panel 220 are also folded along their score lines to form a folded flat 322. The fold apparatus 250 places the folded flat 322 in a second location 324, as illustrated in FIG. 11. As previously discussed with respect to FIG. 1, the second location 324 may be a transfer and assembly area 206. In the transfer and assembly area 206, the container may undergo one or more additional processes such as folding the first side flaps 222 and the second side flaps 224 and/or taping the first side flaps 222 and the second side flaps 224, such as discussed in US Patent Publication No. 2014/0245702.

Further, the container 322 may be advanced in the machine direction MD to downstream processes such as the packaging area 208, where one or more absorbent articles may be loaded into the folded flat. The absorbent articles may be individual absorbent articles or packages of absorbent articles, as discussed in US Patent Publication No. 2014/0245701.

The transfer and assembly area 206 may include a conveyor 338 and a first support member 340 and a second support member 342 defining the second location 342. The first support member 340 and the second support member 340 may be separated by a distance D, which is measured parallel to the machine direction MD. The distance D may be adjusted such that the folded flat 322 may be placed between the first support member 340 and the second support member 340. More specifically, as previously discussed, the vision detection device 314 and/or the illumination source 318 may evaluate the first panel length L1 and the second panel length L2. The second panel length L2 may be the same length as the third panel 218, which is placed between the first support member 340 and the second support member 342. Thus, the vision detection device 314 may communicate the second panel length L2 to the controller which may result in adjusting the distance D between the first support member 340 and the second support member 342 such that the folded flat 322 may be accepted between the support members. It is to be appreciated that if the flat 230 was folded such that the first panel 214 was substantially perpendicular to the first support member 340 and the second support member 342, the first panel length L1 may be communicated to the controller to adjust the first and second support members 340, 342 accordingly.

Further, the controller may also communicate at least one of the first panel length L1 and the second panel length L2 to a taping device (not shown), such as disclosed in US Patent Publication No. 2014/0245702. By communicating the length of the folded flat 322, the taping device may use less tape and more accurately seal the side flaps 222, 224 of the folded flat 322. It is to be appreciated that the controller may also cause other downstream processes to adjust based on the dimensions of the flat 230.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for constructing a folded flat for housing absorbent articles, the method comprising the steps of:

providing a flat comprising a first surface and a second surface opposite the first surface, wherein the first surface comprises a first panel and a second panel, wherein each of the first panel and the second panel include an outer edge and an inner edge extending in a machine direction, and wherein the inner edge of the first panel and the inner edge of the second panel are separated by a first distance extending parallel to a cross direction, and wherein the first panel has a first panel length extending parallel to the cross direction and the second panel has a second panel length extending parallel to the cross direction, and wherein the first panel includes a first score line extending in the machine direction and a tab adjacent the first score line and connected to the second panel;

advancing the flat in a machine direction to a first location;

providing a fold apparatus;

determining at least one of the first distance, the first panel length, and the second panel length with a visual detection device positioned adjacent the fold apparatus at the first location;

adjusting the fold apparatus based on the first distance;

engaging the first surface of the flat with the fold apparatus;

adjusting one or more downstream processes based on the first panel length and the second panel length;

folding the flat along the first score line to construct a folded flat; and placing the folded flat in the second location;

wherein the fold apparatus comprises a first engagement member, a second engagement, and a fold assist member, further comprising the steps of: comparing the first distance with a predetermined distance; engaging the fold assist member and the second engagement member when the first distance is greater than the predetermined distance, wherein the fold assist member is movably positioned between the inner edge of the first panel and the inner edge of the second panel;

and engaging the second engagement member when the first distance is less than the predetermined distance.

2. The method of claim 1, wherein an illumination source is positioned adjacent the flat in the first location.

3. The method of claim 1, wherein the second surface comprises a third panel and a fourth panel, wherein the third panel is separated by the second panel by a second score line, the fourth panel is separated from the third panel by a third score line, and the fourth panel is separated from the first panel by a fourth score line.

4. The method of claim 3, further comprising the step of folding the flat along at least one of the second score line, the third score line, and the fourth score line to form the folded flat.

5. The method of claim 1, wherein the first engagement member comprises one or more receiving members, and wherein each receiving member comprises a receiving surface configured to engage the first surface of the flat.

6. The method of claim 1, wherein the second engagement member comprises an arcuate arm configured to traverse about an arcuate arm pathway, and wherein the arcuate arm has a proximal end portion and a distal end portion opposite the proximal end portion.

7. The method of claim 6, wherein the arcuate arm comprises a press member adjacent the distal end portion, and wherein the press member has a press surface configured to engage the first surface of the flat.

8. The method of claim 1, further comprising the step of supplying pressure to the fold assist member.

9. The method of claim 1, wherein a portion the fold assist member comprises a proximal end portion, a distal end portion opposite the proximal end portion, and a central portion between the proximal end portion and the distal end portion, where the distal end portion comprises a fold fin and the central portion comprises a rigid member, and wherein the fold fin and the rigid member are configured to traverse along a longitudinal fin axis.

10. The method of claim 1, wherein the predetermined distance is greater than about 2 mm.

11. The method of claim 1, wherein the predetermined distance is greater than about 5 mm.

12. The method of claim 1, wherein the fold apparatus is moveable in the machine direction and the cross direction.

13. The method of claim 1, wherein the visual detection device is a camera.

14. The method of claim 1, wherein a controller is operatively connected to the visual detection device.

15. A method for constructing a folded flat for housing absorbent articles, the method comprising the steps of:

providing a flat comprising a first surface and a second surface opposite the first surface, wherein the first surface comprises a first panel and a second panel, wherein each of the first panel and the second panel include an outer edge and an inner edge extending in a machine direction, and wherein the inner edge of the first panel and the inner edge of the second panel are separated by a first distance, and wherein the first panel includes a first score line extending in the machine direction and a tab adjacent the first score line and connected to the first panel;

providing a fold apparatus comprising a first engagement member, a second engagement member, and a fold assist member, wherein the first engagement member comprises a receiving surface and a plane of the receiving surface is parallel with a plane of the first surface of the flat, and wherein the second engagement member comprises a press surface and the press surface is configured to move from a first configuration to a second configuration;

advancing the flat in a machine direction to a first location;

evaluating the first surface of the flat using a visual detection device positioned adjacent the fold apparatus at the first location;

determining the first distance;

engaging a portion of the first panel and the press surface;

engaging a portion of the second panel and the receiving surface;

advancing the flat to a second location;

engaging the fold assist member when the first distance is greater than a predetermined distance, wherein the fold assist member is movably positioned between the inner edge of the first panel and the inner edge of the second panel;

engaging the second engagement member wherein the first distance is greater than, less than, or equal to the predetermined distance, wherein the second engagement member extends about an arcuate pathway; and folding the flat along the first score line such that the first panel is substantially perpendicular to the second panel.

* * * * *